United States Patent [19]

Frederick

[11] Patent Number: 4,982,678

[45] Date of Patent: Jan. 8, 1991

[54] METHOD AND APPARATUS FOR IMPEDING THE SPILLAGE OF A LIQUID CARGO FROM A DAMAGED WATER-TRAVELING VESSEL

[75] Inventor: Carl R. Frederick, Plainfield, N.J.

[73] Assignee: Frederick Research Corp., Plainfield, N.J.

[21] Appl. No.: 359,952

[22] Filed: Jun. 1, 1989

[51] Int. Cl.[5] ..... B63B 25/12

[52] U.S. Cl. ..... 114/74 R; 220/403; 383/119; 428/116

[58] Field of Search ..... 114/74 R, 227, 69, 74 T, 114/74 A; 220/9.2, 71, 403, 404, 426, 445, 448; 383/109, 113, 116, 117, 119; 428/36.1, 36.2, 116, 259; 210/507, 168

[56] References Cited

U.S. PATENT DOCUMENTS

| | | | |
|---|---|---|---|
| 2,991,906 | 7/1961 | Eligoulachvilli | 220/63 |
| 2,994,452 | 8/1961 | Morrison | 220/9 |
| 3,085,027 | 4/1963 | Porteous | 383/119 X |
| 3,167,103 | 1/1965 | Hawthorne et al. | 114/74 T X |
| 3,272,373 | 9/1966 | Alleaume et al. | 220/9 |
| 3,699,912 | 10/1972 | Wilson, Jr. | 114/74 R |
| 3,735,721 | 5/1973 | Leguijt | 114/74 T |
| 3,827,136 | 8/1974 | Yamamoto | 29/455 |
| 3,844,239 | 10/1974 | McLaughlin | 114/74 R |
| 3,882,591 | 5/1975 | Yamamoto | 29/455 |
| 3,906,880 | 9/1975 | Hebert | 114/74 R |
| 3,931,424 | 1/1976 | Helf | 428/33 |
| 3,952,679 | 4/1976 | Grihangne | 114/74 T |
| 4,227,477 | 10/1980 | Preus | 114/256 |
| 4,230,061 | 10/1980 | Roberts et al. | 114/74 A |
| 4,264,443 | 4/1981 | Anderson et al. | 210/168 |
| 4,347,798 | 9/1982 | Gallagher | 114/74 R |
| 4,359,501 | 11/1982 | Di Tullio | 428/259 X |
| 4,373,462 | 2/1983 | Fish | 114/74 R |
| 4,484,533 | 11/1984 | David | 114/74 R |

*Primary Examiner*—Sherman Basinger

*Attorney, Agent, or Firm*—R. Neil Sudol; Henry D. Coleman

[57] ABSTRACT

An assembly for impeding the spillage of petroleum from a damaged oil tanker includes one or more liners made of permeable fabric material provided with reinforcing ribs in the shapes of triangles of two sizes. Triangles of a large size are surrounded by triangles of a small size, such that two small triangles are disposed along each side or edge of a large triangle. The small triangles thus have a side length approximately one half of the side length of the large triangles. The ribs are made of synthetic resin which permeates the fabric material. The liner material is also utilizable, particularly if coated, for a collapsible temporary storage bag which may be inflated in an emergency and pumped full of petroleum from a perforated storage compartment of a damaged tanker.

52 Claims, 7 Drawing Sheets

METHOD AND APPARATUS FOR IMPEDING THE SPILLAGE OF A LIQUID CARGO FROM A DAMAGED WATER-TRAVELING VESSEL

BACKGROUND OF THE INVENTION

This invention relates to a device, apparatus or assembly for impeding the flow of liquid cargo such as petroleum from a storage compartment of a water-traveling vessel such as a tanker upon damage to a hull of the tanker. This invention also relates to a method for minimizing spillage of the liquid cargo into the environment from a damaged compartment of a water-traveling vessel.

Bulk liquid cargo such as petroleum is generally transported in sea-going vessels such as freighters or tankers having a single walled hull defining a hold. Even though the hold of such a ship is usually subdivided into a plurality of storage compartments, those compartments are nevertheless so large that, should an accident occur and the hull of the vessel become perforated or fractured, a great quantity of petroleum or other liquid cargo is likely to spill into the environment. The great ecological damage resulting from such a spill has been brought to the public's attention through several well publicized incidents.

In the case of a shipwrecked or stranded ship, where the hull of the ship has been perforated and a storage compartment bearing liquid cargo is in communication with the sea, the waves act to pump oil from the storage compartment and, over the course of several hours, a large amount of the cargo may be spilled out onto the water.

One previously proposed solution to the problem of minimizing the potential damage due to oil spills is to use a double hull. Such a solution has at least two substantial drawbacks: cost and ineffectiveness. The cost of equipping new tankers with a double hull is obvious. Moreover, it would be practically impossible to retrofit existing tankers with a double hull at any reasonable cost.

A double hull may be ineffective in many situations because whatever can pierce or fracture a steel plate three-quarters of an inch thick could well be sufficiently forceful to pierce a second steel plate spaced a short distance inwardly from the outer hull wall.

An alternative solution to the double hull is the provision of a flexible liner inside each compartment of a petroleum carrying vessel. Such a solution is certainly less expensive than double hulls and can be used in retrofitting existing vessels.

Impermeable flexible liners or bladders are disclosed in U.S. Pat. Nos. 4,230,061 to Roberts et al. and 3,844,239 to McLaughlin et al. Roberts et al. more particularly discloses a petroleum bearing bladder of a woven polyester material coated with a liquid and gas impervious film in the form of a silicone rubber elastomer. Advantages of such a flexible inner liner include easy installation in existing vessels and easy removal to enable repairs on the inner side of the ship's hull. Disadvantages of the liner of Roberts et al. is that it does not conform to the inner wall of the hull and thus reduces the amount of payload. In addition, because the liner must continually support the liquid cargo, the liner is subject to considerable stresses during periods of normal, non-emergency use. Such continual stresses greatly weaken the fabric material and may result, in emergency situations, in failure which otherwise would not have occurred but for the fatigue stressing of the liner material.

McLaughlin et al. is directed to an ejection piping system in which each storage compartment of a tanker is connected via a conduit to an empty space. Each compartment is additionally lined with an impermeable, elastomeric tailored lining releasably fixed to the inner walls of the respective compartment. Upon a deformation of the walls of the storage compartment due to a collision, the liner is released and flexes inwardly to eject the liquid payload, e.g., crude oil, through the conduit to empty space.

The solution of McLaughlin et al. avoids the disadvantages of payload reduction and liner stressing, inasmuch as the liner is, in at least one specific embodiment, disposed in contact with the inner surface of the storage compartment, including the hull. In the event of a collision, the liner separates from the compartment surface. A disadvantage of such a system is that the liner, in being located against the hull, most probably will be torn, shredded or pierced by the same force which opens a hole in the side of the vessel.

The use of flexible liners to contain liquid bulk materials has also been proposed with respect to the transport of cold liquified gases. U.S. Pat. Nos. 3,883,591 and 3,827,136 to Yamamoto, 3,272,373 to Alleaume et al. and 2,994,452 to Morrison all relate to liquified gas storage tanks including a membranous lining. More particularly, both patents to Yamamoto show a low temperature liquified gas tank having an inner membrane provided inside a rigid outer vessel with the interposition of a heat insulating layer. The tank is constructed so that the liner conforms as much as possible to the outer vessel.

Alleaume et al. describes an impermeable inner membrane which contains a cold liquified substance and is in contact with a hull of a ship. The membrane takes the form of a large bag held at its neck at an opening in the top of a storage compartment in which the bag is placed. In several embodiments disclosed in Alleaume et al., two bags are placed within a storage compartment, one bag inside the other, the bags being separated by pressurized gas or cellular material.

Morrison involves a storage facility including a cylindrical outer tank made of steel, an intermediate insulating layer of balsa wood and a inner bag or lining made of a woven glass fiber impregnated and coated with synthetic resin material. A plurality of flexible supporting straps or hangers suspends the bag from the roof of the steel tank.

In solving other problems, including that of transporting two different kinds of fluidic materials in the same storage compartment of a ship so that the materials do not mix or come into contact with one another, U.S. Pat. No. 4,347,798 to Gallagher discloses an expandable bag disposed at the bottom of a storage compartment. The expandable bag may be partially or completely filled with a buffer fluid to protect cargo in the storage compartment from a penetration through the bottom of the compartment. The expandable bag is made of a material which is impervious to liquid cargo contained in the storage compartment.

Another solution to minimizing the spillage of petroleum from a damaged tanker is to provide a floating flexible structure into which the petroleum may be pumped from one or more damaged compartments of the tanker. As disclosed in U.S. Pat. No. 4,373,462 to Fish, such a structure may then be towed away for disposal of the oil. Fish more specifically sets forth a towable tank comprising four elongate pieces fixed to each other by side seams and upper and lower seams to form a receptacle. In addition, clamps are applied to the pieces at the front and the rear of the assembly.

U.S. Pat. No. 4,227,477 to Preus also discloses an inflatable, flexible, towable container for receiving petroleum from a damaged vessel and transporting the petroleum to dockside or to another vessel. The inflatable container is provided along its sides and, in some embodiments, along its entire periphery with gas-inflatable buffer or bumper tubes for protecting the skin of the container from rupturing due to collisions with floating wreckage, jetties, etc.

Two other patents which disclose flexible floating tanks for conveying liquids are U.S. Pat. Nos. 3,952,679 to Grihange and 3,735,721 to Leguijt. A floating tank in accordance with the disclosure of Grihange comprises a pair of elongate tanks disposed side by side and joined to one another by a flexible linking harness. The tanks are internally divided by bulkheads and have oblique forward ends. The tanks' shapes are maintained by inflating gas.

Leguijt disloses an oil storage system comprising rectangular basin divided by partitions into a plurality of compartments each containing an envelope floating in water and in turn containing oil. The envelopes are rectangular when empty and made of impregnated nylon fabric.

Proposing another solution to the problem of confining oil in a tanker upon rupture of the hull of the tanker in an accident, U.S. Pat. No. 2,699,912 to Wilson, Jr. discloses an apparatus including a cup shaped inner barrier and an inverted outer barrier, both comprising panels made of form-sustaining but liquid-tight material sealingly secured to the walls of one or more compartments of a ship's hull. Should the hull be ruptured, the panels deform without rupturing and cooperate with each other to form a seal against the escape of the oil.

OBJECTS OF THE INVENTION

A primary object of the present invention is to provide a method and an associated apparatus or device, utilizable in water-traveling vessels and tankers carrying liquid cargo such as petroleum, for minimizing damage to the environment upon accidental damage to the hull of such a vessel or tanker.

A related object of the present invention is to provide an apparatus, assembly or device for impeding the flow of liquid cargo such as petroleum from a storage compartment of a water-traveling vessel or tanker upon damage to a hull of the tanker.

Another, more particular, object of the present invention is based upon the recognition that, given a major hull penetration in a petroleum carrying tanker, there can be no practical way to ensure that no petroleum will spill out of the tanker into the environment. Accordingly, it is an object of the present invention to convert a potentially major environmental disaster, resulting from an accident to a tanker, to a minor spill which can be easily and quickly cleaned up.

Another object of the present invention is to provide such an apparatus, assembly or device which is installable in existing water-traveling vessels or tankers.

Another, more particular, object of the present invention is to provide such an apparatus, assembly or device which is relatively inexpensive and easy to install in existing water-traveling vessels or tankers.

A further particular object of the present invention is to provide such an apparatus, assembly or device which does not displace payload volume and yet is spaced from the walls of a storage compartment in a tanker so as to reduce the damage to the device upon a rupture in the ship's hull.

Yet another particular object of the present invention is to provide such an apparatus, assembly or device which is lightweight and flexible and yet strong and resistant to damage.

Yet another object of the present invention is to provide an associated method for minimizing petroleum spillage into the environment upon damage to a petroleum-carrying tanker on a body of water.

SUMMARY OF THE INVENTION

A device for impeding the flow of liquid cargo from a storage compartment of a water-traveling vessel upon damage to a hull of the vessel comprises, in accordance with the present invention, a liner including (a) a sheet of fabric material resistant to the liquid cargo and having a predetermined limited degree of permeability thereto and (b) attachment elements for connecting the liner to an inside surface of a wall of the storage compartment of the water-traveling vessel. Preferably, the attachment elements have a predetermined tensile strength sufficiently small so that the attachment elements will rupture upon impact and permit the liner to give way in response to forces which penetrate the ship's hull. The fabric material can be woven, knitted or nonwoven, textile or nontextile.

In accordance with another feature of the present invention, reinforcement elements are attached to the sheet for strengthening the fabric material and for at least inhibiting a tear from spreading in the sheet more than a predetermined distance from a point of perforation of the sheet. This function of the reinforcement elements is vital to preserve the liner's integrity, given the sawing action of knife sharp coral fragments in response to wave motion.

The reinforcement elements advantageously include a multiplicity of ribs disposed at a plurality of different angles with respect to each other. Preferably, the ribs are disposed in closed geometric configurations, most preferably triangles.

Pursuant to a number of particular features of the present invention, the triangles have a plurality of different sizes, specifically exactly two different sizes, and the triangles of a first size have a common side length equal to approximately one-half a common side length of triangles of a second size. Moreover, the triangles of the first size are in a ratio of four to one with respect to triangles of the second size and the triangles of the second size are each surrounded by six triangles of the first size, two of the triangles of the first size being disposed along each side of a triangle of the second size.

Pursuant to another feature of the present invention, the ribs are made of synthetic resin and/or composite material partially permeating the fabric material of the sheet. In a particular embodiment of the invention, the ribs project from both sides of the sheet.

Pursuant to yet another feature of the present invention, the attachment means includes on an outer side of the sheet a plurality of fastening members attached to the ribs.

In a preferred embodiment of the present invention, the device or assembly for impeding the spillage of liquid cargo, such as petroleum, further comprises an additional liner disposed inside of and spaced from the first liner. The additional liner may be disposed essentially concentrically with respect to the first liner so that the panels or walls of the second liner extend substantially parallel to the panels or walls of the first liner. Alternatively, the second or inner liner may be spaced at a varying distance from the first or outer liner.

A sheet for use in fabricating devices for at least partially containing petroleum temporarily comprises, in accordance with the present invention, a web of petroleum-resistant fabric material having a predetermined limited degree of permeability to petroleum and, additionally, in a preferred embodiment of the present invention, reinforcement elements attached to the web for strengthening the fabric material and for at least inhibiting a tear from spreading in the sheet more than a predetermined distance from a point of perforation of the sheet. The reinforcement elements are advantageously ribs disposed in geometric configurations, preferably triangles of two different sizes. In a most effective configuration of the ribs, the triangles of a first size have a common side length equal to approximately one-half a common side length of triangles of a second size and the triangles of the second size are each surrounded by six triangles of the first size, two of the triangles of the first size being disposed along each side of a triangle of the second size.

An apparatus, assembly or device in accordance with the present invention recognizes what appears to be an inescapable fact, namely, that whenever extensive damage occurs to the hull of a petroleum bearing ship, some spillage of the payload will occur. Given a major hull penetration of a sea-going tanker and the forces of the sea, no practical economic means can possibly exist to contain 100% of the cargo. In acknowledging that fact, the present invention seeks to minimize the damage by impeding the flow of petroleum out of the damaged vessel. The invention thus serves (1) to buy critical time between the piercing or fracturing of the ship's hull and the arrival of clean-up crews at the disaster site and (2) to contain approximately 93% of the oil in the tanker despite a major hull intrusion of several feet.

A liner made of a ribbed fabric web or sheet in accordance with the present invention has a limited permeability to petroleum (or other liquid cargo) and thus floats to some degree in the liquid cargo within a storage compartment of a tanker or other water-traveling vessel or ship. Thus, the compartment may be filled to its outer wall (the hull of the ship, in some cases), thereby maximizing the payload. In addition, because the liner is not supporting the payload except in the event of a hull fracture, the liner is not fatigued or otherwise subjected to stresses during normal, non-emergency use, which might weaken the liner and cause failure thereof in the event of an accident.

In prior proposals for using liners in petroleum containing compartments of sea going vessels, the liners, in supporting the entire weight of the payload, could increase roll instability of a ship under adverse weather conditions. The instant invention completely eliminates that disadvantageous eventuality.

The reinforcement ribs on the fabric web of a liner in accordance with the present invention restrict the damage which is done to the liner in an emergency situation. Should the liner be pierced or torn, the ribs prevent the spreading of the tear in the fabric material. A tear is limited generally to the longest linear dimension of the geometric shapes in which the ribs are arranged, for example, to the length of the sides of the large triangles in a large and small triangle configuration in accordance with the preferred embodiment of the present invention. The reinforcement ribs offer enhanced resistance to the cutting or abrading action of coral, rocks or other sharp barrier substances which may enter a breached storage compartment with invading sea water upon a collision of a ship with a reef or other underground barrier and which will be moved by wave action in a sawing type motion capable of cutting through a conventional liner.

Reinforcing the liner material with ribs in geometric configurations such as triangles serves to maximize the strength per unit weight of the liner, while preserving the flexibility thereof. The flexibility enables the liner to absorb shocks to at least a limited degree and further enables the liner to balloon outwardly in the event that the storage compartment is pierced above the water line and the liner has to hold the liquid cargo without support of the hull or sea water.

In the case of a shipwrecked or stranded vessel, where a pumping action accelerates the transport of petroleum from a damaged storage compartment into the sea, the instant invention is effective to counteract or withstand the pumping action, particularly by providing a flexible liner material which is strong and resistant to tearing and cutting by sharp objects floating in the oscillating sea water, as well as resistant to the interchange of oil and water. In fact, small scale tests of a liner material in accordance with the present invention have shown that the porosity of the fabric web or sheet may be selected so as to enable equalization of oil pressure on opposite sides of the fabric web, during normal or non-emergency use of the liner material, and to form a barrier between oil on one side of the fabric material and sea water on an opposite side, during emergency use of the liner.

A method for minimizing petroleum spillage into the environment upon damage to a petroleum-carrying tanker, barge or other vessel on a body of water comprises, in accordance with the present invention, the steps of (a) providing a bag constructed of fabric material having reinforcement ribs of synthetic resin material, (b) unfolding the bag from a folded configuration, (c) placing the bag on the surface of the body of water, (d) pumping petroleum from a compartment of the tanker into the bag, (e) temporarily storing the pumped petroleum in the bag, and (f) removing the petroleum from the bag into another ship, upon such a ship becoming available.

Concomitantly, a bag for the temporary storage of petroleum upon damage to a petroleum-carrying tanker, barge or other water-traveling vessel on a body of water comprises a web of petroleum-resistant fabric material provided with layer which is essentially impervious to petroleum and reinforcement elements attached to the web for strengthening the fabric material and for preventing a tear from spreading in the sheet more than a predetermined distance from a point of perforation of the sheet.

DETAILED DESCRIPTION

Figure 1:
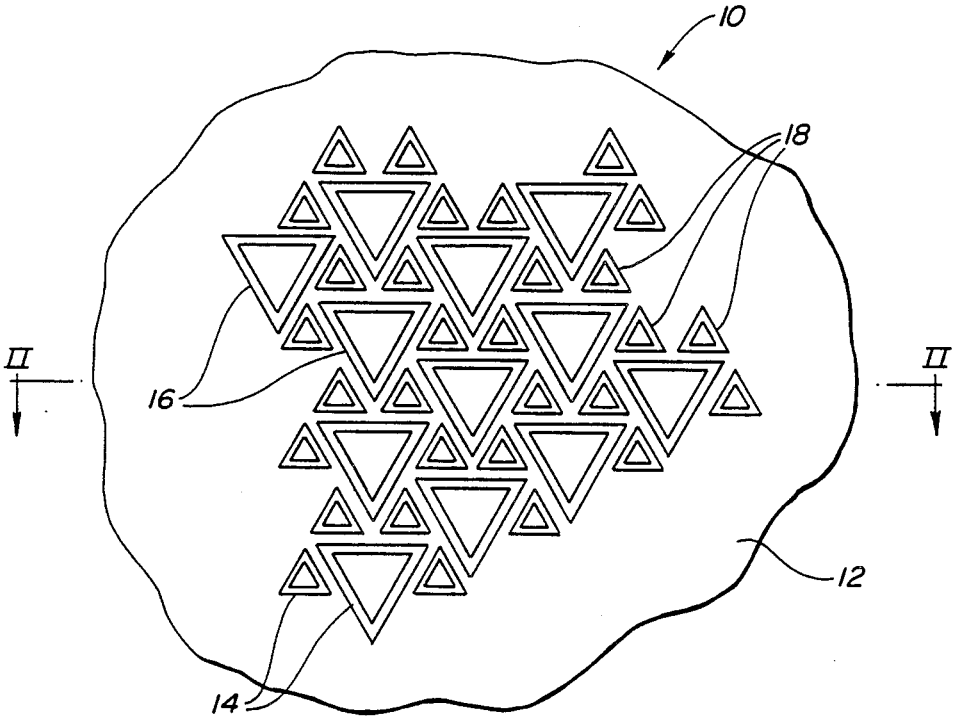
FIG. 1 is a front elevational view of an embodiment of a composite sheet of material, in accordance with the present invention, for lining an oil-bearing compartment of an water-traveling vessel.
Figure 2:
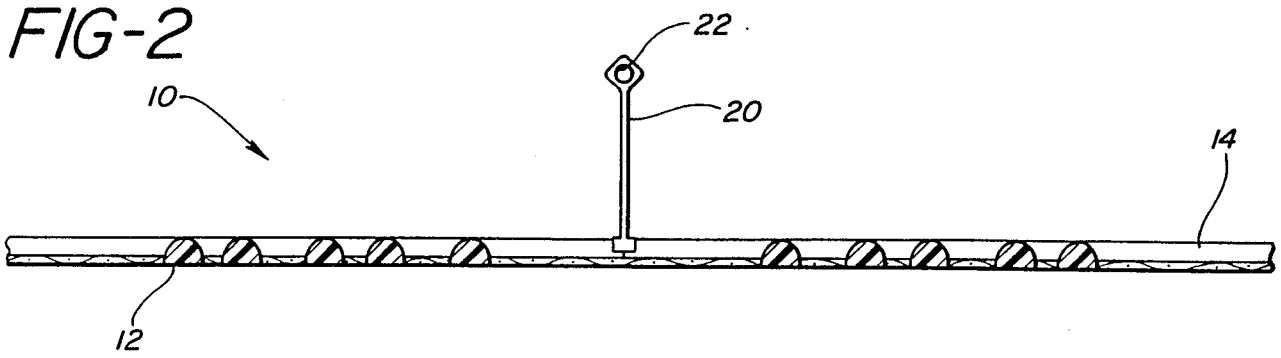
FIG. 2 is a cross-sectional view taken along line II—II in FIG. 1.

As illustrated in FIGS. 1 and 2, a composite liner 10 in accordance with the invention may comprise a woven, knitted, nonwoven or other type of fabric web or sheet 12 made of a strong, abrasion- and petroleum-resistant substance such as NOMEX$_{tm}$. Web 12 is provided on at least one side (FIG. 2) with reinforcement ribs 14 made of a tough, hard, but flexible synthetic resin material such as TEFLON$_{tm}$, molded nylon, EPDM, rubber-like or reinforced composite material.

Ribs 14 are arranged in an array of closed geometrical or polygonal configurations, preferably in the form of large equilateral triangles 16 and small equilateral triangles 18. Each large triangle 16 is surrounded by six small triangles 18, with two small triangles disposed along each side of the large triangle. Although each large triangle 16 is at the center of six small triangles 18 spaced a short distance therefrom, there are only four times as many small triangles 18 as large triangles 16. Small triangles 18 have a common side length approximately one-half the length of the sides of large triangles 16.

The plastic and/or composite material of reinforcement ribs 14 permeates the fabric material of web 12 in the areas of the ribs so that the web is partially embedded in the plastic material.

Liner 10, made of the material shown in FIGS. 1 and 2, is installed in each payload compartment of an oil tanker prior to the filling of the respective compartment with petroleum. As illustrated in FIG. 2, liner 10 is provided with a plurality of flexible rods or tethers 20 exemplarily made of an oil-resistant plastic or fiber material for connecting the liner to the hull of the tanker and for spacing the liner a distance of one to ten feet inwardly from the hull. Each rod or tether 20 may be integrally connected at on end to a semi-flexible reinforcement triangle 16 or 18. At an opposite end, each spacer rod or tether is provided with connection means such as an eyelet 22.

Pursuant to an important feature of the invention, fabric web 12 has a predetermined permeability to petroleum, whereby the liner 10 can essentially float in the oil in a tanker compartment. The permeability of the liner enables an equalization of pressure across the liner, thereby minimizing long term stress on the liner during periods of normal, non-emergency use. In addition, because the liner can float in an oil storage compartment, the entire compartment may be filled with payload, while the liner is nevertheless spaced from the walls of the storage compartment and, therefore, from the hull of the tanker. This spacing is also important for purposes of reducing damage to the liner upon a piercing of the hull in a collision, inasmuch as forces capable of penetrating a ¾ inch steel plate and ripping therein a hole as large as or larger than twenty feet across would easily pierce a liner lying against the steel plate of the hull.

Damage to the liner in the event of a collision is also reduced by the tough, but flexible, structure of the liner. In most collisions, the liner will give, rather than being breached.

In accordance with another important feature of the invention, reinforcement ribs 14 have an arrangement which prevents the spreading or elongation of a tear or rip made in liner 10 upon a grounding of a tanker on a shoal or reef. Reinforcement ribs 14 block any tear from extending a distance greater than the common length of the sides of large triangles 18.

Because liner 10 floats within an oil storage compartment at a pre-established distance (determined by the lengths of spacer rods 20) from the hull of a vessel, the liner is less subject to damage than a second, inner hull would be upon perforation of the vessel's outer hull, e.g., by a shoal or reef. The floating of the liner and its flexibility serve to minimize the damage to the liner. Moreover, if the liner is damaged in a collision or by abrasion against metal shards or sharp edges of a hole in a tanker's hull, the plastic reinforcement ribs minimize the extent of the damage to the liner.

The minimization of damage to the liner serves to minimize the spillage of oil from a damaged petroleum bearing compartment. However, the invention recognizes that 100% retention of the petroleum payload is practically and economically unfeasible and therefore it surrenders an estimated 2% to 7% of the payload in the breched compartment to the environment.

It is to be noted that the disposition of reinforcement ribs 14 in triangles 16 and 18 is preferred because of the inherent strength of the triangle. However, other geometric shapes are also possible, provided that the arrangement of the shapes prevents the spread of rips or tears in the fabric material of the liner. In addition, ribs 14 may have a cross-section other than the semicircular shape shown in FIG. 2. The semicircular cross-section is preferred inasmuch as it is believed to result in stronger and yet more flexible ribs than other possible cross-sections, such as rectangular or polygonal.

Figure 3:
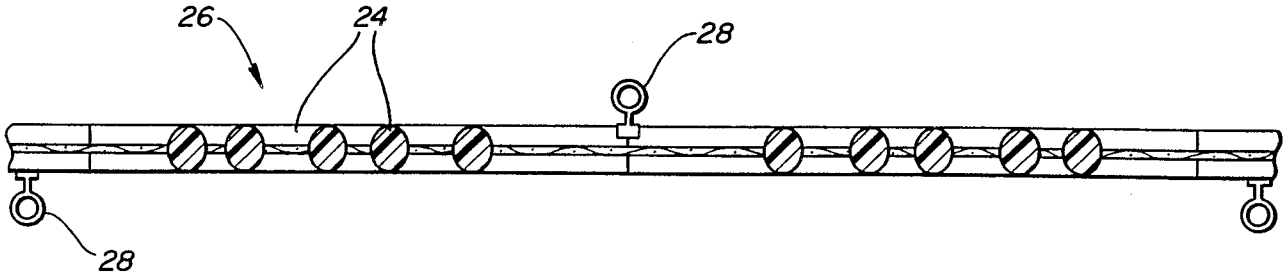
FIG. 3 is a cross-sectional view similar to FIG. 2, illustrating a modified embodiment of a composite sheet of lining material, in accordance with the present invention.

As depicted in FIG. 3, a liner 26 may be provided with triangular reinforcement ribs 24 which project from both sides of the liner. In addition, hooks or eyelets 28 or other fastener alternatives may be attached in a regular pattern to the front and back sides of liner 26. Eyelets 28 enable anchoring of a front or outer side of liner 26 to an inner surface of a vessel's hull and simultaneously enable connection of the back or inner side of liner 26 to a second liner 30 (FIG. 4) disposed inside the first to provide two layers of protection against the leakage of oil from a damaged vessel. In that case, both liners float in petroleum during periods of normal, i.e, non-emergency, use.

It is to be noted that eyelets 28 on the front side of liner 26 (FIG. 3) are shifted with respect to the eyelets on the back side of the liner so that inner liner 30, connected to outer liner 26 by flexible spacer rods 32 (FIG. 4), is laterally staggered with respect thereto. The relative staggering of liners 26 and 30 stengthens the liner assembly inasmuch as the reinforcement ribs on one liner may be at least partially criss-crossed with respect to the ribs on the other liner.

Figure 4:
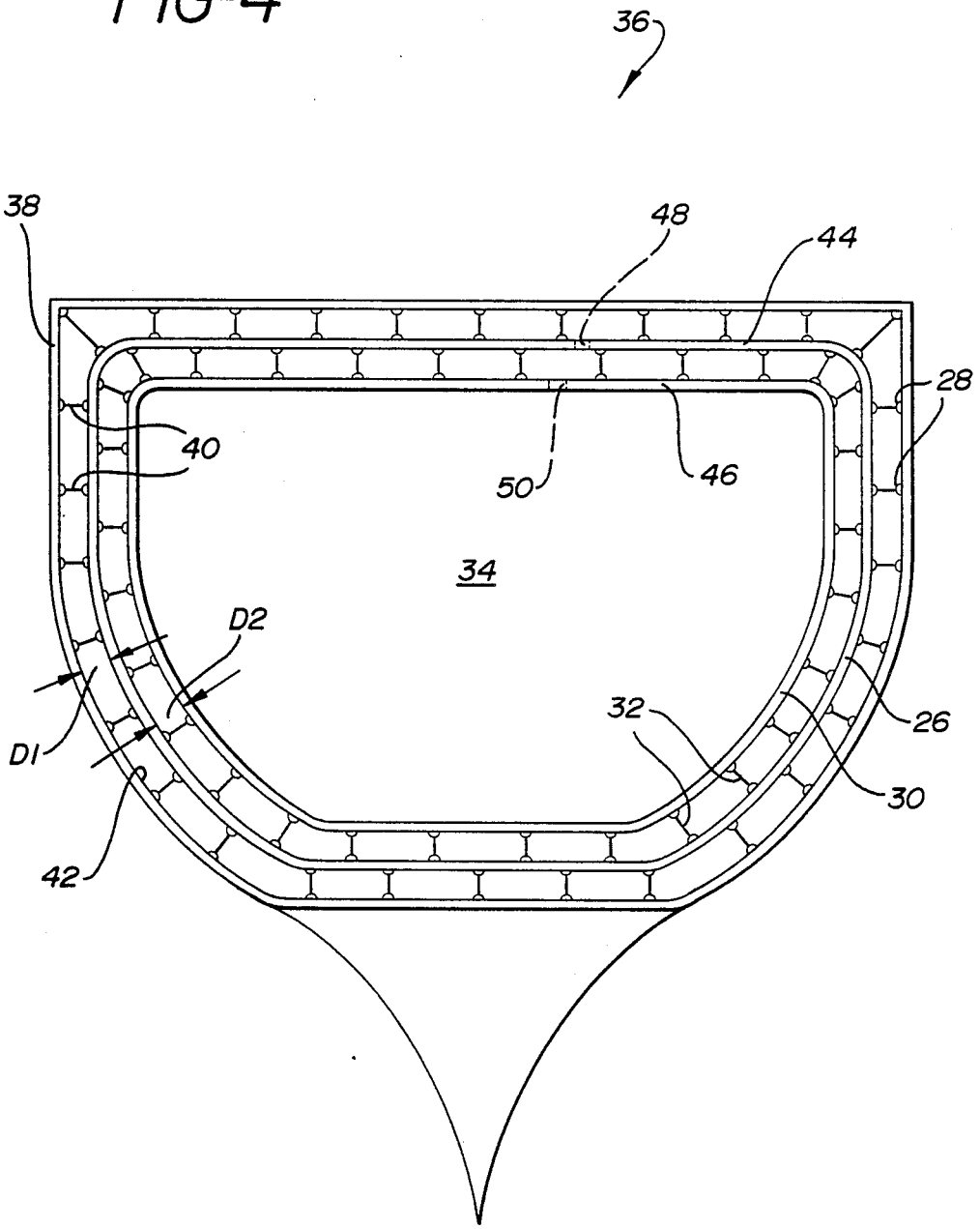
FIG. 4 is a schematic cross-sectional view of a payload compartment of a tanker equipped with a pair of liners in a first configuration in accordance with the present invention.

As illustrated in FIG. 4, outer liner 26 and inner liner 30 each assume the shape of a large bag which substantially conforms to a liquid storage compartment 34 in a sea-going tanker 36. In some cases, as depicted in FIG. 4, the storage compartment may extend the breadth of the tanker 36. In other cases, the hold of the tanker may be subdivided by partitions in both the longitudinal and transverse directions, relative to the tanker's overall dimensions, to form a plurality of large storage compartments. In any case, each separate storage compartment is provided with its own liner or plurality of liners made of the material described hereinabove with reference to FIGS. 1 and 2 or 3.

In the case depicted in FIG. 4, tanker 36 has a hull 38 which defines in part storage compartment 34. Outer liner 26 is thus connected by a plurality of flexible spacer bars or tethers 40 to an inner surface 42 of hull 38 and is spaced by spacer bars 40 a substantially uniform distance D1 inwardly of hull 38. Similarly, inner liner 30 may be supported or disposed at a substantially uniform distance D2 from outer liner 26 so that upper, lower and side panels of the inner liner are substantially parallel to corresponding panels of the outer liner.

Liners 26 and 30 are advantageously provided along respective upper panels 44 and 46 with openings 48 and 50 for facilitating the introduction of petroleum into the liners and also the removal of the petroleum from storage compartment 34.

It is to be understood that the thicknesses of liners 26 and 30 have been exaggerated in FIG. 4 for purposes of illustration. In actuality, distances D1 and D2 will generally be between one and ten feet, while ribs 14 and 24 will have thicknesses preferably between one and four inches.

Figure 5:
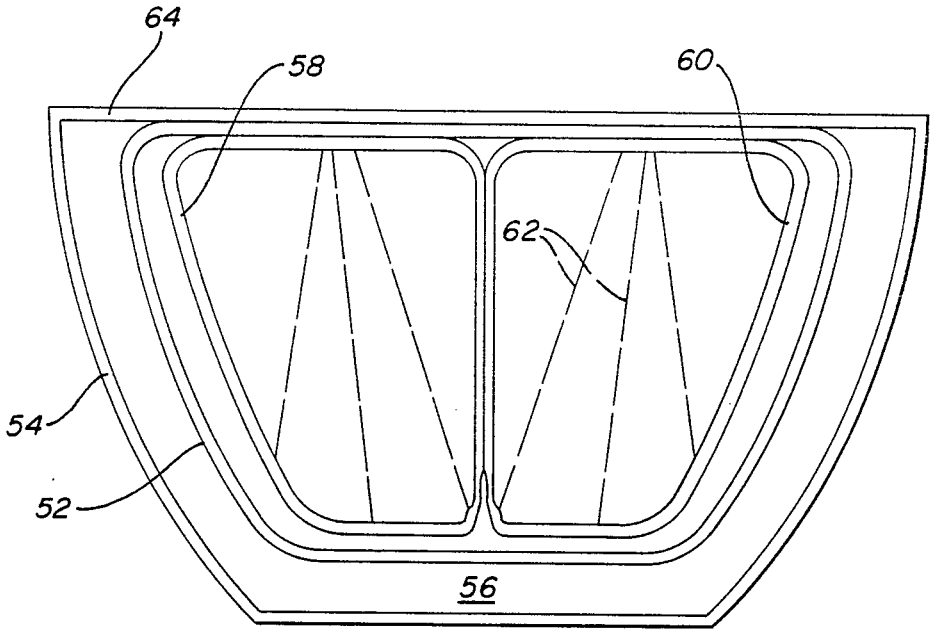
FIG. 5 is a schematic cross-sectional view of a payload compartment of a tanker equipped with a pair of liners in a second configuration in accordance with the present invention.

As shown in FIG. 5, an assembly for impeding the flow of liquid cargo from a storage compartment of a water-traveling vessel upon damage to a hull of the vessel may, in accordance with an embodiment of the present invention, comprise an outer liner 52 disposed parallel to a wall 54 (e.g., the hull) of a liquid storage compartment 56 of a water-traveling tanker. Provided inside outer liner 52 is a plurality of inner liners 58 and 60 disposed outside of one another. Liners 52, 58 and 60 all have the structure illustrated in FIGS. 1 and 2 or 3, except that eyelets, hooks or other connectors are provided on the liners in configurations appropriate to the assembly shown in FIG. 5. As indicated in that drawing figure, tethers or stays 62 may be connected to liners 52, 58 and 60 and to an upper wall 64 of compartment 56 for providing supplementary support to the liners in the event that petroleum exits from the storage compartment without being replaced by sea water. Tethers, ropes or rods which are installed between outer liner 52 and hull 54 for connecting the liner to the hull and also for spacing and arranging the liner inside storage compartment 56, have been omitted from FIG. 5 for purposes of simplicity. Likewise, additional tethers or other connectors between inner liners 58 and 60 and outer liner 52 have been omitted.

Figure 6:
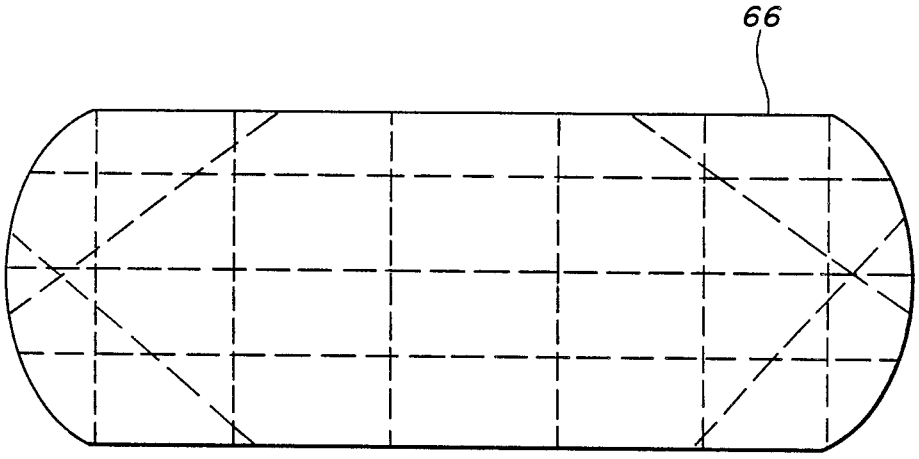
FIG. 6 is a schematic side elevational view of a temporary petroleum storage bag in accordance with the present invention.
Figure 7:
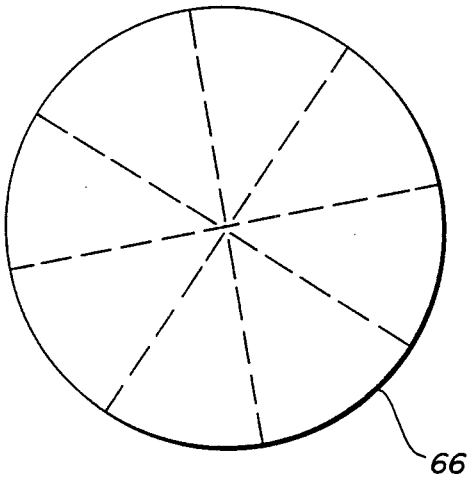
FIG. 7 is an end elevational view of the temporary storage bag of FIG. 6.

As illustrated in FIGS. 6 and 7, the ribbed fabric material of liners 10, 26 and 30, may be used in the construction of a foldable temporary storage bag 66 which may be several hundred feet long and half that dimension in width. FIGS. 6 and 7 show the bag in an inflated or expanded condition with structural subunits or sections being indicated by dashed lines. The bag is advantageously provided with a coating or layer of petroleum impermeable material such as a synthetic resin.

Bag 66 is advantageously stored in a folded state on the deck of a petroleum bearing tanker. Upon the occurrence of a collision and resulting damage to the liner (or liners) inside a storage compartment of the tanker, so that the liner is incapable of adequately stemming the outrush of oil, bag 66 is placed onto the water's surface and inflated, either through the application of pneumatic pressure, or through the introduction of petroleum. The oil from the damaged compartment of the tanker is pumped from the damaged compartment into bag 66 and subsequently stored there while the bag is towed to a port or until the liquid can be pumped into another vessel. The bag floats on the surface of the water because its contents, namely, petroleum, are lighter than water. Therefore, only limited auxiliary flotation bladders may be required. An attached automatic radio beacon may be included for ensuring recovery of the bag should it break free of its mooring.

Figure 8:
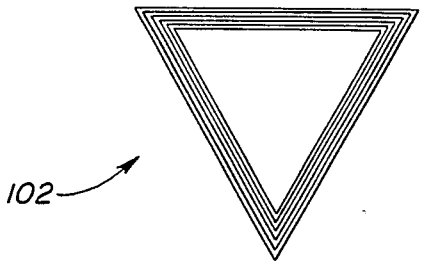
FIG. 8 is an elevational or top view of a particular embodiment of a triangular reinforcement rib on a liner sheet, in accordance with the present invention.
Figure 9:
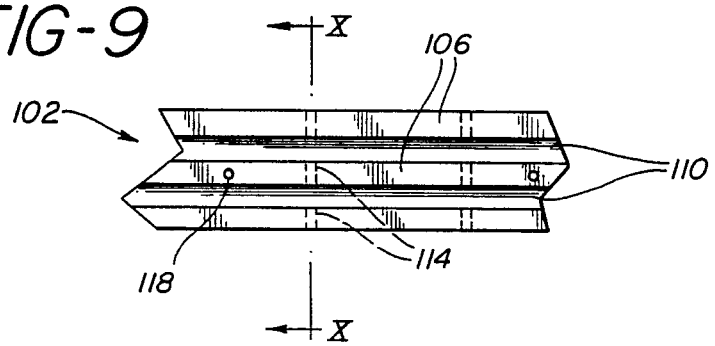
FIG. 9 is an elevational or top view of the triangular reinforcement rib of FIG. 8, on an enlarged scale.
Figure 10:
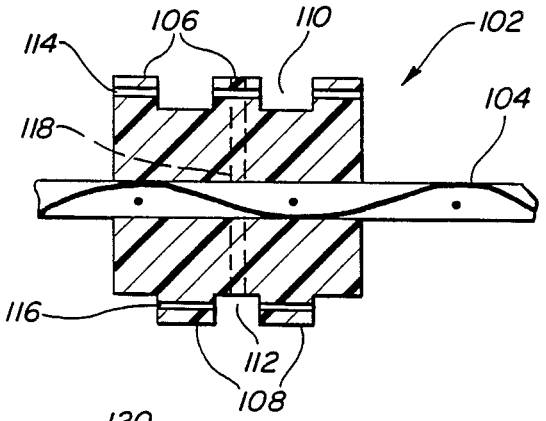
FIG. 10 is a transverse cross-sectional view of the triangular reinforcement rib of FIG. 9 and an underlying fabric web or sheet, on a yet larger scale.

As depicted in FIGS. 8, 9 and 10, a triangular reinforcement rib 102 on a liner sheet or web 104 may be provided on each side of the liner sheet, in accordance with the present invention, with a series of longitudinally extending beads 106 and 108 defining a plurality of longitudinally extending grooves or recesses 110 and 112. Beads 106 on one side of sheet 104 are transversely staggered with respect to beads 108 on an opposite side of the sheet so that the beads and grooves on one sheet may matingly interlock with the beads and grooves on another sheet to at least temporarily fasten the two sheets together.

As shown in FIGS. 9 and 10, beads 106 and 108 may each be provided with one or more transversely oriented holes 114 and 116 for receiving tethers or other tensile elements (not illustrated) for releasably fastening a liner to the inner wall of a petroleum storage compartment of a water-traveling tanker. In addition, triangular reinforcement ribs 102 may be formed with a plurality of bores 118 oriented transversely to sheet 104 for receiving a bolt (not illustrated).

Upon the perforating of a liner made of the reinforced sheet material of FIGS. 9 and 10, a sheet of the same material may be attached over the perforation by aligning beads 106 and grooves 110 on the triangular reinforcement ribs of one sheet (e.g., the liner sheet) with beads 108 and grooves 112 on the triangular reinforcement ribs on another sheet (the patch sheet). The interlocking beads and grooves serve to temporarily hold the patch sheet to the damaged liner until a repair crew can drive connecting bolts (not illustrated) through aligned bores 118 of the two sheets to securely fasten them together.

Figure 11:
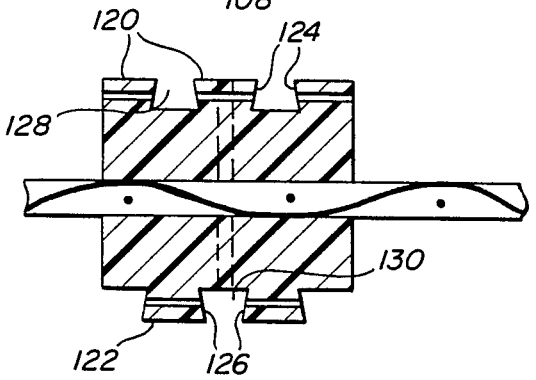
FIG. 11 is a transverse cross-sectional view of another triangular reinforcement rib, pursuant to the present invention.
Figure 13:
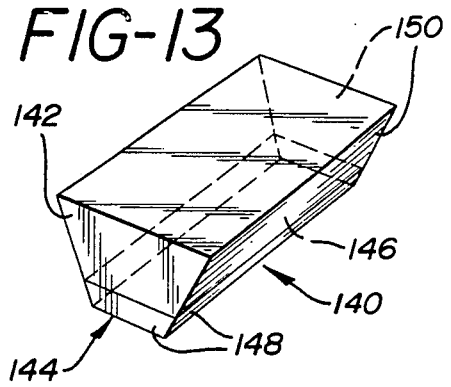
Figure 14:
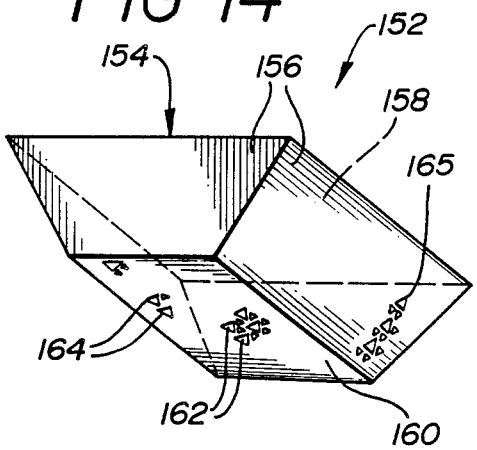
Figure 15:
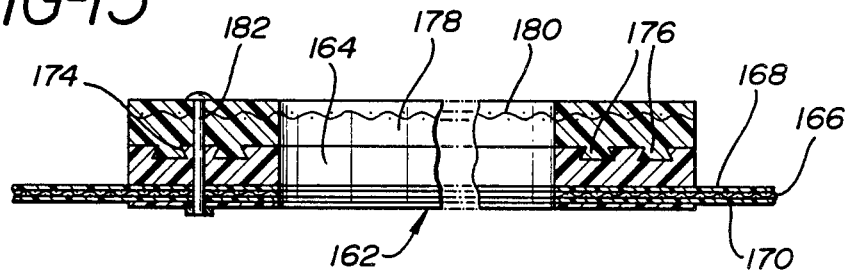
Figure 16:
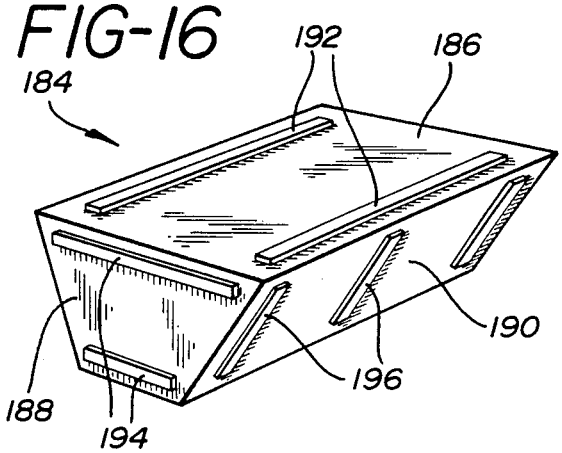
Figure 17:
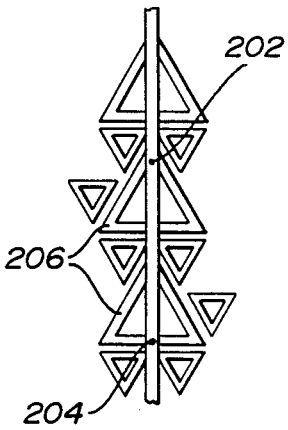
Figure 18:
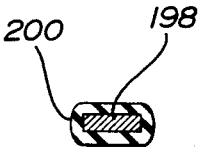

FIG. 11 shows a modified embodiment of the rib infrastructure illustrated in FIGS. 9 and 10. Beads 120 and 122 may be formed with beveled sidewalls 124 and 126 to form tapered grooves 128 and 130 which are wider at an inner side than an outer side. The groove and bead cross-sections shown in FIG. 11 serve to enhance the gripping capability of those structural features.

Figure 12:
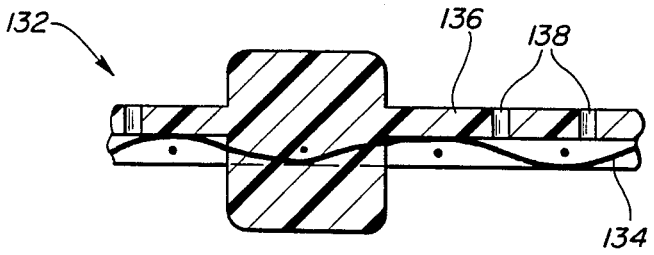
FIG. 12 is a cross-sectional view, similar to FIGS. 2 and 3, showing yet another embodiment of a liner sheet in accordance with the present invention.

As depicted in FIG. 12, a liner in accordance with the present invention may be formed of a sheet material 132 comprising a fabric web 134 coated on at least one of two sides with a layer 136 of latex or other rubber-like material. The rubbery layer 136 is formed With an array of bores 138 which are precisely engineered, both in their densities and diameters, for controlling the permeability of sheet material 132 to petroleum. The rubber layer serves to enhance the resistance of the sheet material to the shearing action of coral and other sharp objects which may impact against a liner upon the occurrence of an accident at sea.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proferred by way of example to facilitate comprehension of the invention and should not be construed to limit the scope thereof.

What is claimed is:

1. A device for impeding the flow of liquid cargo from a storage compartment of a water-traveling vessel upon damage to a hull of said vessel, said device comprising:

a liner including:

a sheet of fabric material resistant to the liquid cargo and having a predetermined limited degree of permeability thereto; and reinforcement means attached to said sheet for strengthening said fabric material and for at least inhibiting a tear from spreading in said sheet more than a predetermined distance from a point of perforation of said sheet; and support means for supporting said liner inside the storage compartment of the water-traveling vessel.

2. The device defined in claim 1 wherein said reinforcement means includes a multiplicity of ribs disposed at a plurality of different angles with respect to each other.

3. The device defined in claim 2 wherein said ribs are disposed in closed geometric configurations.

4. The device defined in claim 3 wherein said ribs are disposed in triangles.

5. The device defined in claim 4 wherein said triangles have a plurality of different sizes.

6. The device defined in claim 5 wherein said triangles have exactly two different sizes.

7. The device defined in claim 6 wherein triangles of a first size of said two different sizes have a common side length equal to approximately one-half a common side length of triangles of a second size of said two different sizes.

8. The device defined in claim 7 wherein triangles of said first size are in a ratio of four to one with respect to triangles of said second size.

9. The device defined in claim 8 wherein said triangles of said second size are each surrounded by six triangles of said first size, two of said triangles of said first size being disposed along each side of a triangle of said second size.

10. The device defined in claim 4 wherein said ribs are made of synthetic resin material partially permeating the fabric material of said sheet.

11. The device defined in claim 4 wherein said ribs project from both sides of said sheet.

12. The device defined in claim 4 wherein said support means includes on an outer side of said sheet a plurality of fastening members attached to said ribs.

13. The device defined in claim 3 wherein said closed geometric configurations are of a plurality of different sizes.

14. The device defined in claim 2 wherein said ribs are made of synthetic resin material partially permeating the fabric material of said sheet.

15. The device defined in claim 2 wherein said ribs project from both sides of said sheet.

16. The device defined in claim 2 wherein said support means includes on an outer side of said sheet a plurality of fastening members attached to said ribs.

17. The device defined in claim 1, further comprising an additional line disposed inside of and spaced from the first liner.

18. The device defined in claim 1 wherein said liquid cargo is petroleum.

19. The device defined in claim 1 wherein said fabric material is woven fabric material.

20. An assembly for impeding the flow of liquid cargo from a storage compartment of a water-traveling vessel upon damage to a hull of said vessel, said assembly comprising:

a first liner including a fabric material resistant to said liquid cargo and having a predetermined limited degree of permeability of said liquid cargo; and attachment means for connecting said first liner to an inside surface of a wall of said storage compartment;

a second liner including a fabric material resistant to said liquid cargo; and disposition means for disposing said second liner inwardly of said first liner.

21. The assembly defined in claim 20 wherein the fabric material of said second liner has a predetermined limited degree of permeability to said liquid cargo.

22. The assembly defined in claim 21 wherein said first liner is provided with reinforcement means attached to the fabric material of said first liner for strengthening said fabric material and for at least inhibiting a tear from spreading in said fabric material more than a predetermined distance from a point of perforation of said fabric material.

23. The assembly defined in claim 22 wherein said second liner is provided with additional reinforcement means attached to the fabric material of said second liner for strengthening said second liner and for preventing a tear from spreading in said second liner more than a predetermined distance from a point of perforation of said second liner.

24. The assembly defined in claim 23 wherein the reinforcement means of said first liner and said second liner include a multiplicity of ribs disposed at a plurality of different angles with respect to each other.

25. The assembly defined in claim 24 wherein said ribs are disposed in closed geometric configurations.

26. The assembly defined in claim 25 wherein said ribs are disposed in triangles having two different sizes, triangles of a first size of said two different sizes having a common side length equal to approximately one-half a common side length of triangles of a second size of said two different sizes, triangles of said first size being in a ratio of four to one with respect to triangles of said second size, triangles of said second size being each surrounded by six triangles of said first size, two of said triangles of said first size being disposed along each side of a triangle of said second size.

27. The assembly defined in claim 25 wherein said ribs are made of synthetic resin material partially permeating the fabric material of said first liner and said second liner.

28. The assembly defined in claim 27 wherein said ribs project from both sides of said first sheet and said second sheet.

29. The assembly defined in claim 25 wherein said second liner is spaced a substantially uniform distance from said first liner essentially parallel to said first liner, the geometric configurations of the ribs on said second liner being identical to the geometric configurations or the ribs on said first liner and being laterally staggered with respect thereto upon installation of said first liner and said second liner in the storage compartment of the water-traveling vessel.

30. The assembly defined in claim 20 wherein said second liner is spaced a substantially uniform distance from said first liner essentially parallel to said first liner.

31. The assembly defined in claim 20 wherein said second liner is spaced a varying distance from said first liner.

32. The assembly defined in claim 20 wherein said liquid cargo is petroleum.

33. The assembly defined in claim 20 wherein the fabric material of said first liner is woven fabric material.

34. A sheet for use in fabricating devices for at least partially containing petroleum temporarily, said sheet comprising:

a web of petroleum-resistant fabric material having a predetermined limited degree of permeability to petroleum; and reinforcement means attached to said web for strengthening said fabric material and for at least inhibiting a tear from spreading in said sheet more than a predetermined distance from a point of perforation of said sheet, said reinforcement means including a multiplicity of ribs disposed in triangles having exactly two different sizes, triangles of a first size of said two different sizes having a common side length equal to approximately one-half a common side length of triangles of a second size of said two different sizes.

35. The sheet defined in claim 34 wherein triangles of said first size are in a ratio of four to one with respect to triangles of said second size.

36. The sheet defined in claim 35 wherein said triangles of said second size are each surrounded by six triangles of said first size, two of said triangles of said first size being disposed along each side of a triangle of said second size.

37. The sheet defined in claim 34 wherein said ribs are made of synthetic resin material partially permeating the fabric material of said sheet.

38. The sheet defined in claim 34 wherein said ribs project from both sides of said sheet.

39. The sheet defined in claim 34, further comprising attachment means for connecting said sheet to an inside surface of a wall of a storage compartment of an water-traveling vessel, wherein said attachment means includes on an outer side of said sheet a plurality of fastening members attached to said ribs.

40. The sheet defined in claim 34, further comprising a layer of essentially impermeable petroleum-resistant material attached to said web.

41. The sheet defined in claim 34 wherein said material is a woven fabric material.

42. A device for impeding the flow of petroleum from a storage compartment of a water-traveling vessel upon damage to a hull of said vessel, said device comprising:

a liner of petroleum-resistant material having a predetermined limited degree of permeability to petroleum; and support means for supporting said liner inside the storage compartment of the vessel.

43. The device defined in claim 42 wherein said material is a fabric material.

44. The device defined in claim 42 wherein said material is a woven fabric material.

45. The device defined in claim 42 wherein said material is a knitted fabric material.

46. The device defined in claim 42 wherein said support means also serves to space the liner from the inside surface of the wall of the storage compartment of the vessel.

47. The device defined in claim 42, further comprising reinforcement means attached to said liner for strengthening said fabric material and for at least inhibiting a tear from spreading in said liner more than a predetermined distance from a point of perforation of said liner.

48. A device for impeding the flow of liquid cargo from a storage compartment of a water-traveling vessel upon damage to a hull of said vessel, said device comprising:

a liner including:

a sheet of fabric material resistant to the liquid cargo;

a layer of resilient rubber-like material on one side of said sheet, said rubber-like material being resistant to the liquid cargo, said layer being provided with an array of bores for imparting a predetermined limited degree of permeability of said layer to the liquid cargo; and ribbed reinforcement means attached to said sheet for strengthening said fabric material and said layer and for at least inhibiting a tear from spreading in said sheet more than a predetermined distance from a point of perforation of said sheet; and attachment means for connecting said liner to an inside surface of a wall of the storage compartment of the water-traveling vessel and for spacing said liner inwardly from said inside surface.

49. A device for impeding the flow of liquid cargo from a storage compartment of a water-traveling vessel upon damage to a hull of said vessel, said device comprising:

a liner including:

a sheet of material resistant to the liquid cargo and having a predetermined limited degree of permeability thereto; and reinforcement ribs attached to said sheet for strengthening said material and for at least inhibiting a tear from spreading in said sheet more than a predetermined distance from a point of perforation of said sheet, said ribs being provided with means for locking the ribs on one sheet to the ribs on another sheet; and attachment means for connecting said liner to an inside surface of a wall of the storage compartment of the water-traveling vessel and for spacing said liner inwardly from said inside surface.

50. The device defined in claim 49 wherein said means for locking includes grooves and beads in an outwardly facing surface of the reinforcement ribs.

51. The device defined in claim 49 wherein said material is a fabric material.

52. The device defined in claim 49 wherein said material is a woven fabric material.

* * * * *

UNITED STATES PATENT AND TRADEMARK OFFICE

CERTIFICATE OF CORRECTION

PATENT NO. : 4,982,678

DATED : January 8, 1991

INVENTOR(S) : Carl R. Frederick

It is certified that error appears in the above-identified patent and that said Letters Patent is hereby corrected as shown below:

Delete drawing Figures 13 through 18.

Signed and Sealed this

Thirteenth Day of August, 1991

*Attest:*

HARRY F. MANBECK, JR.

*Attesting Officer*

*Commissioner of Patents and Trademarks*